US009395670B2

(12) United States Patent
Hikosaka

(10) Patent No.: US 9,395,670 B2
(45) Date of Patent: Jul. 19, 2016

(54) IMAGE FORMING APPARATUS THAT REDUCES VARIATION OF COUNT OF PRINTABLE SHEETS PER TONER CONTAINER, IMAGE FORMING METHOD, AND RECORDING MEDIUM

(71) Applicant: Kyocera Document Solutions Inc., Osaka (JP)

(72) Inventor: Ariyoshi Hikosaka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/866,849

(22) Filed: Sep. 26, 2015

(65) Prior Publication Data

US 2016/0091851 A1 Mar. 31, 2016

(30) Foreign Application Priority Data

Sep. 26, 2014 (JP) ..... 2014-197556

(51) Int. Cl.
*G03G 15/00* (2006.01)

(52) U.S. Cl.
CPC ..... *G03G 15/556* (2013.01)

(58) Field of Classification Search
CPC .... G03G 15/553; G03G 15/556; G03G 21/02
See application file for complete search history.

(56) References Cited

FOREIGN PATENT DOCUMENTS

| | | | |
|---|---|---|---|
| JP | H10-319789 A | | 12/1998 |
| JP | 2005-208339 A | | 8/2005 |
| JP | 2013029657 A | * | 2/2013 |

OTHER PUBLICATIONS

Muramoto (JP 2013-029657 A), Feb. 2013, JPO Computer Translation.*

* cited by examiner

*Primary Examiner* — Erika J Villaluna
(74) *Attorney, Agent, or Firm* — James Judge

(57) ABSTRACT

An image forming apparatus includes a print mode setting circuit, an average printing amount identifying circuit, a parameter setting circuit, and an image processing circuit. The print mode setting circuit sets to normal print mode or ecological print mode whose toner usage is less than a toner usage of the normal print mode. The average printing amount identifying circuit identifies an average printing rate in a predetermined count of printed sheets or an average amount of toner consumption per sheet. The parameter setting circuit decreases a printing rate parameter value in the ecological print mode based on a ratio of a predetermined reference value to the identified average printing rate or the identified average amount of toner consumption. The image processing circuit multiplies tone values of a print image by the printing rate parameter value in the ecological print mode to reduce a printing rate of the print image.

5 Claims, 3 Drawing Sheets

IMAGE FORMING APPARATUS THAT REDUCES VARIATION OF COUNT OF PRINTABLE SHEETS PER TONER CONTAINER, IMAGE FORMING METHOD, AND RECORDING MEDIUM

INCORPORATION BY REFERENCE

This application is based upon, and claims the benefit of priority from, corresponding Japanese Patent Application No. 2014-197556 filed in the Japan Patent Office on Sep. 26, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus, which employs an electrophotographic method, such as a printer and a multi-functional peripheral, extracts toner from a toner cartridge to form an image.

One image forming apparatus detects a remaining amount of toner in a toner container using a toner-remaining amount detecting sensor. In response to detection of "toner-near end," a display unit displays a message for prompting a toner container exchange. When the toner container is not exchanged, the image forming apparatus automatically switches to ecological print mode.

Another image forming apparatus switches to ecological print mode after a toner remaining amount reaches a predetermined level.

SUMMARY

An image forming apparatus according to one aspect of the disclosure includes a print mode setting circuit, an average printing amount identifying circuit, a parameter setting circuit, and an image processing circuit. The print mode setting circuit sets a print mode to a normal print mode or an ecological print mode whose toner usage is less than a toner usage of the normal print mode. The average printing amount identifying circuit identifies an average printing rate in a predetermined count of printed sheets or an average amount of toner consumption per sheet. The parameter setting circuit decreases a printing rate parameter value in the ecological print mode based on a ratio of a predetermined reference value to the identified average printing rate or the identified average amount of toner consumption. The image processing circuit multiplies tone values of a print image by the printing rate parameter value in the ecological print mode to reduce a printing rate of the print image.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
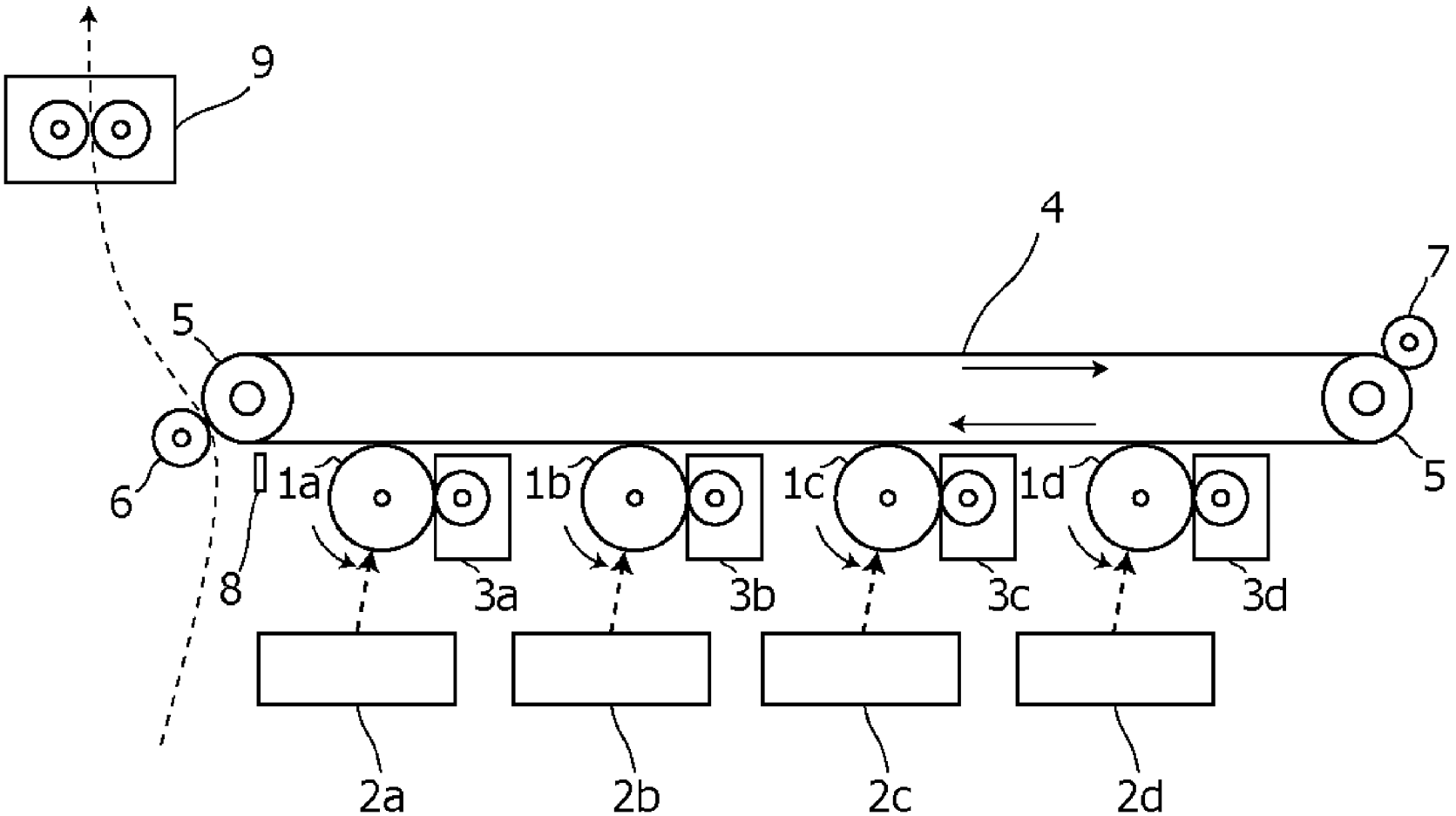
FIG. 1 illustrates a part of a mechanical internal configuration of an image forming apparatus according to one embodiment of the disclosure from a side view.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure based on the drawings.

FIG. 1 illustrates a part of a mechanical internal configuration of an image forming apparatus according to one embodiment of the disclosure from a side view. The image forming apparatus according to the one embodiment is an apparatus that has a printing function, such as a printer, a facsimile device, a copier, a multi-functional peripheral, using an electrophotographic method.

The image forming apparatus of the embodiment includes a tandem type color developing device. The color developing device includes photoreceptor drums 1*a* to 1*d*, exposure apparatuses 2*a* to 2*d*, and developer units 3*a* to 3*d*. The photoreceptor drums 1*a* to 1*d* are photoreceptors for four colors of cyan, magenta, yellow, and black. The photoreceptor drums 1*a* to 1*d* are made of, for example, amorphous silicon.

The exposure apparatuses 2*a* to 2*d* are apparatuses, which irradiate the photoreceptor drums 1*a* to 1*d* with a laser beam while scanning the laser beam to form electrostatic latent images. The laser beam is scanned in a perpendicular direction (main-scanning direction) to a rotation direction (sub-scanning direction) of the photoreceptor drums 1*a* to 1*d*. The exposure apparatuses 2*a* to 2*d* include a laser scanning unit including a laser diode, which is a light source of the laser beam, and an optical device (such as a lens, a mirror, and a polygon mirror), which guides the laser beam to the photoreceptor drums 1*a* to 1*d*.

Additionally, a charger such as a scorotron, a cleaning apparatus, a static eliminator and similar apparatus are located around the photoreceptor drums 1*a* to 1*d*. The cleaning apparatus removes remaining toner on the photoreceptor drums 1*a* to 1*d* after a primary transfer, and the static eliminator eliminates static charges of the photoreceptor drums 1*a* to 1*d* after the primary transfer.

The developer units 3*a* to 3*d* includes toner cartridges, which are filled with respective four color toners of cyan, magenta, yellow, and black, and the development devices, which cause toners conveyed from toner hoppers in the toner cartridges to attach on the photoreceptor drums 1*a* to 1*d*. The developer units 3*a* to 3*d* cause the toner to attach on electrostatic latent images on the photoreceptor drums 1*a* to 1*d* to form toner images. A toner conveying unit, which is operated by a driving device such as a motor (not illustrated), conveys the toner from the toner hopper to the development device.

The photoreceptor drum 1*a*, the exposure apparatus 2*a* and the developer unit 3*a* perform the magenta toner development. The photoreceptor drum 1*b*, the exposure apparatus 2*b* and the developer unit 3*b* perform cyan toner development. The photoreceptor drum 1*c*, the exposure apparatus 2*c* and the developer unit 3*c* perform yellow toner development. The photoreceptor drum 1*d*, the exposure apparatus 2*d* and the developer unit 3*d* perform black toner development.

An intermediate transfer belt 4 contacts the photoreceptor drums 1*a* to 1*d*, and is an annular image carrier (intermediate transfer member) on which toner images on the photoreceptor drums 1*a* to 1*d* are primarily transferred. The intermediate transfer belt 4 is stretched by a drive roller 5, and a driving power from the drive roller 5 causes the intermediate transfer belt 4 to move circularly in a direction of a contact position on the photoreceptor drum 1*a* from a contact position on the photoreceptor drum 1*d*.

A transfer roller 6 causes a conveyed paper sheet to contact the intermediate transfer belt 4, and secondarily transfer the toner image on the intermediate transfer belt 4 onto the paper sheet. Then, the paper sheet on which the toner image is transferred is conveyed to a fixing unit 9, and then the toner image is fixed on the paper sheet.

A roller 7 includes a cleaning brush, causes the cleaning brush to contact the intermediate transfer belt 4, and removes a residual toner on the intermediate transfer belt 4 after the toner image is transferred onto the paper sheet or after a calibration.

A sensor 8 irradiates the intermediate transfer belt 4 with a light to detect a reflected light from a surface of the intermediate transfer belt 4 or a toner pattern on the surface of the intermediate transfer belt 4. For example, when calibrating a toner tone, the sensor 8 irradiates a predetermined region on the intermediate transfer belt 4 (a region on which a toner patch for calibration is transferred) with the light, and detects the reflected light of the light to output an electrical signal corresponding to the light intensity. The toner tone calibration is a calibration that adjusts the plurality levels of toner print density to become respective reference print densities using toner patches corresponding to a plurality of levels of toner print density from the zero print density to the solid print density.

Figure 2:
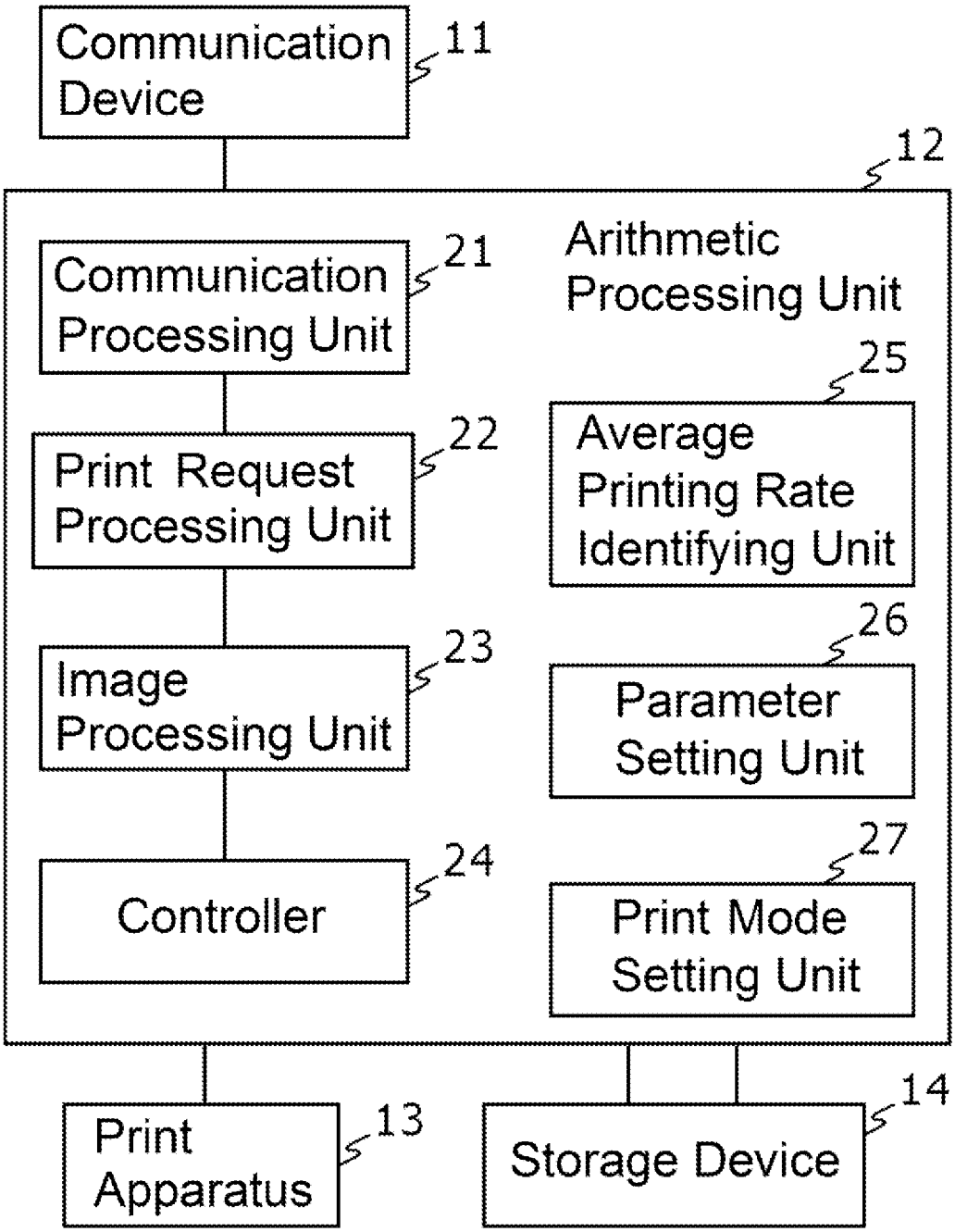
FIG. 2 illustrates a part of an electrical configuration of the image forming apparatus according to the one embodiment.

FIG. 2 illustrates a part of an electrical configuration of the image forming apparatus according to the embodiment of the disclosure. As illustrated in FIG. 2, this image forming apparatus includes a communication device 11, an arithmetic processing unit 12, a print apparatus 13, and a storage device 14.

The communication device 11 is a device connectable to a host apparatus via a network or a peripheral interface, and performs data communication in a predetermined communication protocol.

The arithmetic processing unit 12 is a computer that includes a central processing unit (CPU) (not illustrated), a read only memory (ROM), a random access memory (RAM), and similar member. The arithmetic processing unit 12 loads programs from, for example, a storage device (not illustrated), which is a non-transitory computer-readable recording medium, and the ROM into the RAM, and the CPU executes the program. This ensures function as various processing units.

The print apparatus 13 is an internal device that has a mechanical configuration illustrated in FIG. 1, and prints a document image.

The storage device 14 is a non-volatile storage device such as a flash memory, and stores setting data and similar data.

In the embodiment, the image forming apparatus requires a user to login the image forming apparatus for use based on a user ID, and then a user who is permitted to login based on a login operation (for example, inputting user ID) to, for example, an operation panel (not illustrated) can use the image forming apparatus. Additionally, in the embodiment, print modes are switched and printing rate is adjusted for respective users who login in such a way (that is, for each registered user) as follows.

After activation of the image forming apparatus, the arithmetic processing unit 12 accordingly executes various programs. In the embodiment, the arithmetic processing unit 12 functions as processing units of an operating system (not illustrated), a communication processing unit 21, a print request processing unit 22, an image processing unit 23, a controller 24, an average printing rate identifying unit 25, a parameter setting unit 26, and a print mode setting unit 27.

The communication processing unit 21 is a processing unit that controls the communication device 11 to perform data communications with, for example, the host apparatus. For example, the communication processing unit 21 receives document data as a print request from the host apparatus.

The print request processing unit 22 accepts a print request based on a user operation to the operation panel and a print request provided from the host apparatus to perform a print job corresponding to the request. For example, when receiving the document data in a predetermined data format such as Page Description Language (PDL) and Portable Document Format (PDF) as a print request from the host apparatus, the print request processing unit 22 generates image data using the document data. The image data is bitmap data, and when receiving the document data as bitmap data from the host apparatus, the print request processing unit 22 directly uses the document data as the image data.

The image processing unit 23 a circuit that performs a predetermined image process (for example, a color conversion and a screen process) for the image data to generate print data (for example, binarized print image data for respective colors).

The controller 24 is a processing unit that monitors and controls an internal device such as the print apparatus 13. The controller 24 is a processing circuit that controls a driving source for driving, for example, the above described rollers (not illustrated), a bias applying circuit for applying a developing bias and a primary transfer bias, and the exposure apparatuses 2*a* to 2*d*, so as to perform developing, transferring and fixing a toner image, a paper feeding, a printing, and a paper discharging. The developing biases are applied between the photoreceptor drums 1*a* to 1*d* and the respective developer units 3*a* to 3*d*. The primary transfer biases are each applied between the photoreceptor drums 1*a* to 1*d* and the intermediate transfer belt 4. Especially, the controller 24 controls the driving device, which operates the toner conveying unit described above, and a toner conveyance in the developer units 3*a* to 3*d*.

The average printing rate identifying unit 25 identifies an average printing rate in a predetermined count of printed sheets (for example, 1000 sheets) based on the image data before a screen process or the image data after the screen process. While in this embodiment a case of a monochrome printing is assumed, in a case of color printing, the average printing rate identifying unit 25 identifies average printing rates of the whole CMYK to identify an ecological rate described below based on the largest rate among the respective CMYK (cyan, magenta, yellow, and black) average printing rates, and simply applies the identified ecological rate commonly to the CMYK.

The parameter setting unit 26 a circuit that decreases a printing rate parameter (hereinafter referred to as an "ecological rate") value in the ecological print mode based on a ratio of a predetermined reference value to the identified average printing rate. The image processing unit 23 multiplies tone values of a print image by a printing rate parameter set by the parameter setting unit 26 in the ecological print mode so as to reduce a printing rate of the print image.

For example, in the case of average printing rate, the above-described reference value is a value (for example, 5%) used when calculating a standard count of printable sheets per one toner container.

For example, when the reference value is 5%, and the identified average printing rate is 6%, an ecological rate is 83.3% (=5/6×100%).

For example, the following assumes a case where the ecological rate is 83.3%. In this case, for example, the image processing unit 23 changes a pixel value of 255 (a value before a screen process) of a print image in 256 tones into a pixel value of 212, which is the pixel value of 255 multiplied by the ecological rate of 83.3%, in the ecological print mode.

The print mode setting unit 27 is a circuit that sets a print mode for executing a print job into any of a normal print mode (that is, a mode where an amount of toner consumption is not reduced) or the ecological print mode, whose toner usage is less than the normal print mode.

In the embodiment, the parameter setting unit 26 can select one of a first mode, a second mode, and a third mode based on setting data stored in the storage device 14. The first mode is a mode that immediately changes a ratio of the above-described reference value to the above-described average printing rate into the printing rate parameter value. The second mode is a mode that changes the ratio of the above-described reference value to the above-described average printing rate in phases into the printing rate parameter value. The third mode is a mode that does not permit a change of the printing rate parameter value. The setting data is set by, for example, a user operation.

In the embodiment, when an average printing rate identified by the average printing rate identifying unit 25 is larger than the above-described reference value, the print mode setting unit 27 forcedly sets the print mode from the normal print mode into the ecological print mode. When a count of printed sheets after the ecological print mode is set becomes equal to or more than a predetermined value, and the average printing rate identified by the average printing rate identifying unit 25 is equal to or less than the above-described reference value, the print mode setting unit 27 returns the print mode from the ecological print mode into the normal print mode.

Figure 3:
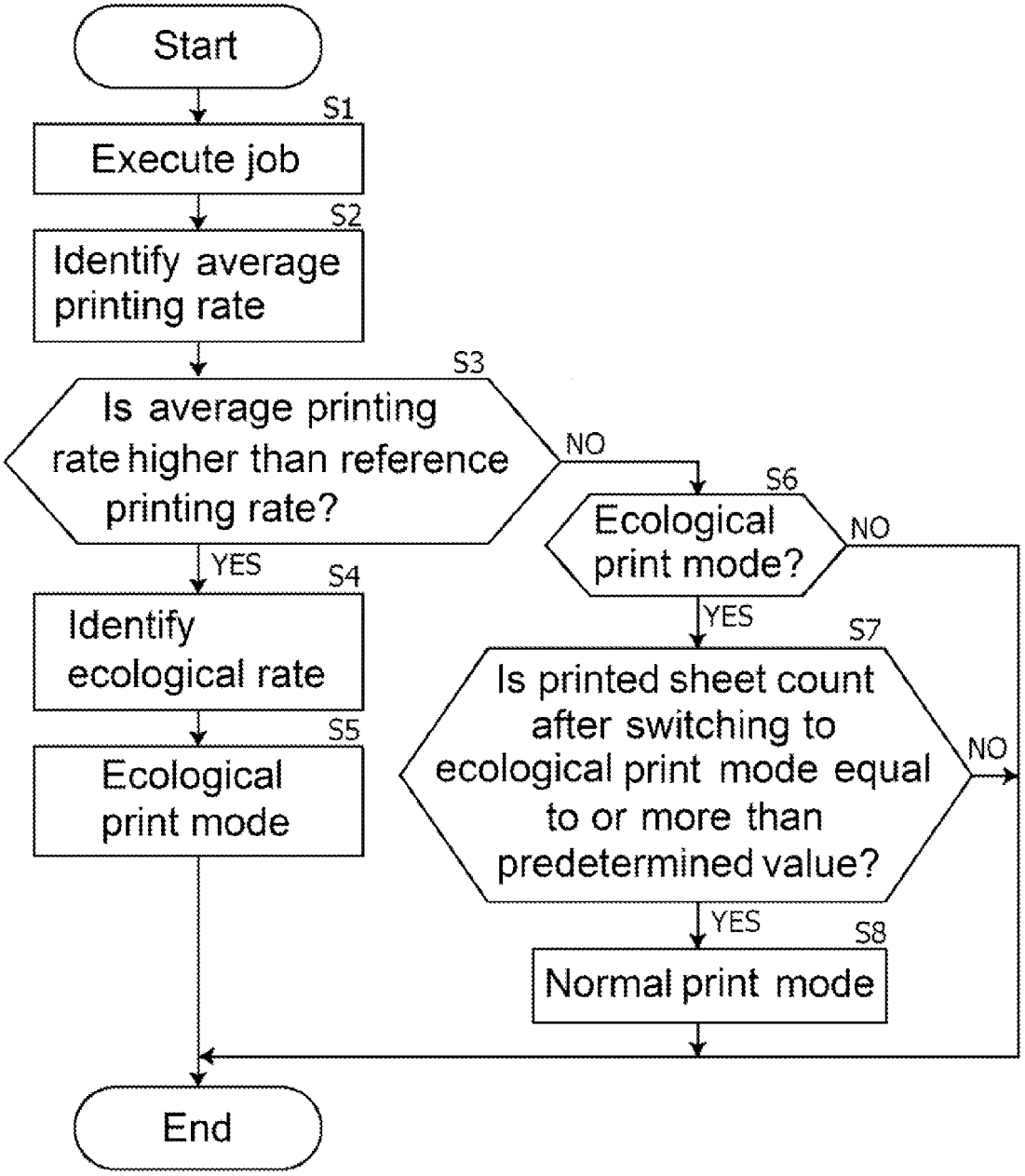
FIG. 3 illustrates an operation of the image forming apparatus according to the one embodiment.

Next, the following describes an operation of the above-described image forming apparatus. FIG. 3 illustrates an operation of the image forming apparatus illustrated in FIG. 1.

First, every time a print job is completed (Step S1), the average printing rate identifying unit 25 identifies an average printing rate in the latest predetermined count of printed sheets (Step S2). When the identified average printing rate is larger than the predetermined reference value (Step S3), the parameter setting unit 26 decreases an ecological rate value based on the ratio of the predetermined reference value to the identified average printing rate (Step S4). Then, the print mode setting unit 27 forcedly set the print mode for executing the print job into the ecological print mode (Step S5).

Before the ecological print mode is forcedly set at Step S5, the user can manually set the print mode into any of the normal print mode and the ecological print mode. After the ecological print mode is forcedly set at Step S5, the ecological print mode prohibits the user from manually returning the print mode into the normal print mode until the print mode is returned into the normal print mode at Step S8 described below or a toner container is exchanged.

When the ecological print mode is forcedly set at Step S5, the forced setting into the ecological print mode and environmental effects or economic effects, which are achieved by the ecological print mode (for example, a $CO_2$ reduction amount per 1000 printed sheets under a set ecological rate and an increase amount of the count of printable sheets), are notified to the user. The notification may be displayed on an operation panel (not illustrated) of the image forming apparatus, or may be transmitted to and displayed at a host apparatus (a driver), which has transmitted a print request to the image forming apparatus, or the notification may be transmitted to the user by an e-mail.

When the ecological print mode is forcedly set, the parameter setting unit 26 refers to the setting data to identify a set mode (a mode that changes the ecological rate) in the setting data. The ecological rate is calculated corresponding to the mode when the first mode or the second mode is set. In a case of the second mode, the ecological rate is reduced from 100% (that is, the ecological rate in the normal print mode) to the ratio of the reference value to the average printing rate in phases by a predetermined count of printed sheets through a predetermined count of phases. For example, when the ratio of the reference value to the average printing rate is 80% in the second mode, the first ecological rate is 90%, and then the ecological rate is reduced to 80%. The count of phases for reducing the ecological rate should not be limited to this. For example, the ecological rate may be reduced by increments of 1%.

When the third mode is set in the setting data, the ecological print mode is not forcedly set, and a notification, which recommends a switch to the ecological print mode (that is, a change of the setting data by the user), is transmitted to the user.

As described above, the forced setting into the ecological print mode causes an execution of a subsequent print job in the ecological print mode, and causes the image processing unit 23 to multiply the tone values of the print image by the ecological rate set by the parameter setting unit 26 to reduce a printing rate of the print image.

The ecological rate is changed after completion of a print job. That is, the ecological rate is not changed before job completion of a print job in execution.

On the other hand, when the average printing rate is not larger than the reference value at Step S3, the print mode setting unit 27 determines whether or not the ecological print mode is forcedly set, and a count of printed sheets after the ecological print mode is forcedly set is equal to or more than the predetermined value (Steps S6 and S7). For example, the controller 24 counts the count of printed sheets.

When the ecological print mode is forcedly set, and the count of printed sheets after the ecological print mode is forcedly set is equal to or more than the predetermined value, the print mode setting unit 27 releases the forced setting into the ecological print mode to return the print mode into the normal print mode (Step S8).

As described above, according to the above-described embodiment, the print mode setting unit 27 sets the print mode into any of the normal print mode or the ecological print mode. The average printing rate identifying unit 25 identifies the average printing rate in the predetermined count of printed sheets. The parameter setting unit 26 decreases the printing rate parameter value in the ecological print mode based on the ratio of the predetermined reference value to the identified average printing rate. In the ecological print mode, the image processing unit 23 multiplies the tone values of the print image by the printing rate parameter to reduce the printing rate of the print image.

Thus, as the average printing rate becomes high compared with the reference printing rate, the ecological rate becomes low. This reduces a variation of the count of printable sheets per toner container.

Modifications

For example, in the above-described embodiment, the average printing rate identifying unit 25 identifies the average printing rate for each user group in the predetermined count of printed sheets, and the parameter setting unit 26 may decrease the printing rate parameter value in the ecological print mode for each user group based on the ratio of the above-described reference value to the above-described average printing rate. In this case, corresponding to the user group, a reduction width of the ecological rate may be reduced, and a lower limit value of the ecological rate may be set. Attribute information (a user ID, a password, a group ID of a user group to which the registered user belongs, for example) of each registered user is managed as user data, and the average printing rate for each user group is identified based on the attribute information.

Additionally, in the above-described embodiment, the average printing rate identifying unit 25 collectively identifies the average printing rates of a predetermined plurality of user groups in the predetermined count of printed sheets. The parameter setting unit 26 may collectively decrease the printing rate parameter values of the predetermined plurality of the user groups in the ecological print mode based on the ratio of the above-described reference value to the above-described average printing rate. The group data indicating the plurality of the user groups, which are collectively handled, is preliminarily set to identify the plurality of the groups, which are collectively handled, based on the group data.

When the average printing rate in the predetermined count of printed sheets is out of a predetermined range after the ecological print mode is forcedly set in the above-described embodiment, this may be notified to the user.

While in the above-described embodiment, the average printing rate is used as an amount indicating an average printing amount per sheet, an average amount of toner consumption per sheet may be used instead of the average printing rate. The average amount of toner consumption per sheet can be calculated based on, for example, the average printing rate. The average printing rate identifying unit 25 is one exemplary circuit of an average printing amount identifying unit, and identifies an average printing rate as the amount indicating the average printing amount.

The disclosure is applicable to an image forming apparatus such as a printer, a multi-functional peripheral.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

a print mode setting circuit that sets a print mode to a normal print mode or an ecological print mode whose toner usage is less than a toner usage of the normal print mode;

an average printing amount identifying circuit that identifies an average printing rate in a predetermined count of printed sheets or an average amount of toner consumption per sheet;

a parameter setting circuit that decreases a printing rate parameter value in the ecological print mode based on a ratio of a predetermined reference value to the identified average printing rate or the identified average amount of toner consumption; and an image processing circuit that multiplies tone values of a print image by the printing rate parameter value in the ecological print mode to reduce a printing rate of the print image; wherein the parameter setting circuit selects one of a first mode and a second mode based on setting data, the first mode immediately changing the ratio of the reference value to the average printing rate or the average amount of toner consumption into the printing rate parameter value, and the second mode changing the ratio of the reference value to the average printing rate or the average amount of toner consumption in phases into the printing rate parameter values.

2. The image forming apparatus according to claim 1, wherein:

the average printing amount identifying circuit identifies an average printing rate or an average amount of toner consumption per sheet for each user or each user group in a predetermined count of printed sheets; and the parameter setting circuit decreases the printing rate parameter value in the ecological print mode for each user or each user group based on a ratio of the reference value to the average printing rate or the average amount of toner consumption.

3. An image forming apparatus, comprising:

a print mode setting circuit that sets a print mode to a normal print mode or an ecological print mode whose toner usage is less than a toner usage of the normal print mode;

an average printing amount identifying circuit that identifies an average printing rate in a predetermined count of printed sheets or an average amount of toner consumption per sheet;

a parameter setting circuit that decreases a printing rate parameter value in the ecological print mode based on a ratio of a predetermined reference value to the identified average printing rate or the identified average amount of toner consumption; and an image processing circuit that multiplies tone values of a print image by the printing rate parameter value in the ecological print mode to reduce a printing rate of the print image; wherein when the average printing rate or the average amount of toner consumption identified by the average printing amount identifying circuit is larger than the reference value, the print mode setting circuit forcedly sets the print mode from the normal print mode into the ecological print mode, and when a count of printed sheets after setting to the ecological print mode becomes equal to or more than a predetermined value, and the average printing rate or the average amount of toner consumption identified by the average printing amount identifying circuit is equal to or less than the reference value, the print mode setting circuit forcedly returns the print mode from the ecological print mode into the normal print mode.

4. The image forming apparatus according to claim 3, wherein:

the average printing amount identifying circuit identifies an average printing rate or an average amount of toner consumption per sheet for each user or each user group in a predetermined count of printed sheets; and the parameter setting circuit decreases the printing rate parameter value in the ecological print mode for each user or each user group based on a ratio of the reference value to the average printing rate or the average amount of toner consumption.

5. An image forming apparatus, comprising:

a print mode setting circuit that sets a print mode to a normal print mode or an ecological print mode whose toner usage is less than a toner usage of the normal print mode;

an average printing amount identifying circuit that identifies an average printing rate in a predetermined count of printed sheets or an average amount of toner consumption per sheet;

a parameter setting circuit that decreases a printing rate parameter value in the ecological print mode based on a ratio of a predetermined reference value to the identified average printing rate or the identified average amount of toner consumption; and an image processing circuit that multiplies tone values of a print image by the printing rate parameter value in the ecological print mode to reduce a printing rate of the print image; wherein the average printing amount identifying circuit collectively identifies an average printing rate or an average amount of toner consumption per sheet of a plurality of predetermined user groups in a predetermined count of printed sheets, and the parameter setting circuit collectively decreases the printing rate parameter value of the plurality of predetermined user groups in the ecological print mode based on a ratio of the reference value and the average printing rate or the average amount of toner consumption.

* * * * *